United States Patent [19]

Johnson

[11] Patent Number: 4,551,964

[45] Date of Patent: Nov. 12, 1985

[54] PACKING CASE TAB SLITTER

[75] Inventor: Lloyd D. Johnson, Portland, Conn.

[73] Assignee: Standard-Knapp, Inc., Portland, Conn.

[21] Appl. No.: 677,317

[22] Filed: Nov. 30, 1984

Related U.S. Application Data

[62] Division of Ser. No. 254,638, Apr. 16, 1984, , which is a division of Ser. No. 75,324, Sep. 12, 1979, Pat. No. 4,291,518.

[51] Int. Cl.[4] ..... B65B 7/20

[52] U.S. Cl. ..... 53/374; 53/381 R; 198/461

[58] Field of Search ..... 53/374, 381 R, 375, 53/167, 491

[56] References Cited

U.S. PATENT DOCUMENTS

| | | | |
|---|---|---|---|
| 2,669,342 | 2/1954 | Neal | 198/732 |
| 2,679,313 | 5/1954 | Gueffroy et al. | 198/461 |
| 2,929,183 | 3/1960 | Magna | 53/374 |
| 2,979,995 | 4/1961 | Bergstein et al. | 53/374 X |
| 3,077,062 | 2/1963 | Brumbaugh | 53/374 X |
| 3,146,566 | 9/1964 | Roth | 53/374 |
| 3,368,660 | 2/1968 | Standley et al. | 198/461 |
| 3,373,543 | 3/1968 | Nigrelli et al. | 53/381 R |
| 3,721,330 | 3/1973 | Crawford et al. | 198/461 |
| 3,827,545 | 8/1974 | Buhayer | 198/461 |
| 4,010,597 | 3/1977 | Nelson | 53/374 |
| 4,360,098 | 11/1982 | Nordstrom | 198/460 |

FOREIGN PATENT DOCUMENTS

| | | | |
|---|---|---|---|
| 1479168 | 5/1966 | France | 198/461 |

*Primary Examiner*—Horace M. Culver

*Attorney, Agent, or Firm*—McCormick, Paulding & Huber

[57] ABSTRACT

Cardboard packing cases, which have been loaded with bottles or the like, are fed to apparatus for severing the top flap connecting tabs at diagonally opposite corners of the case. These tabs are provided to hold the top flaps of the case in place during loading, but must be severed prior to closing and/or gluing of the top flaps at a succeeding stage in the packing of the product. The apparatus includes an infeed station where the cases are separated, by slowing each case on a flight bar conveyor having its flight spaced less than the length of the case, and then accelerating the case on the infeed conveyor to match the speed of a pocket chain conveyor. The case has its forward end lifted, and opposite corners tilted, on this pocket chain conveyor to spread the top flaps at the two corners of the case without connecting tabs. Guide plates on either side of the pocket chain conveyor serve to guide the case so that fixed knives cut both tabs without necessity for turning the case through 90 degrees. The front tab is cut by dropping the front end of the case downwardly as it returns to a horizontal position on the pocket chain conveyor. Front and rear top flap tuckers follow an upwardly inclined path to cam the front and rear top flaps away from the continuously moving case, and a rotating flap closing wheel moves these front and rear top flaps inwardly onto the top of the case so that the side flaps can be subsequently plowed into place.

8 Claims, 25 Drawing Figures

10
12
14
16
18
20
22
24
26
28
30
32
34
36
36c
38
42
44
48
50a
60
62
70
72
80
82
92
94
96
98
100

FIG. 5
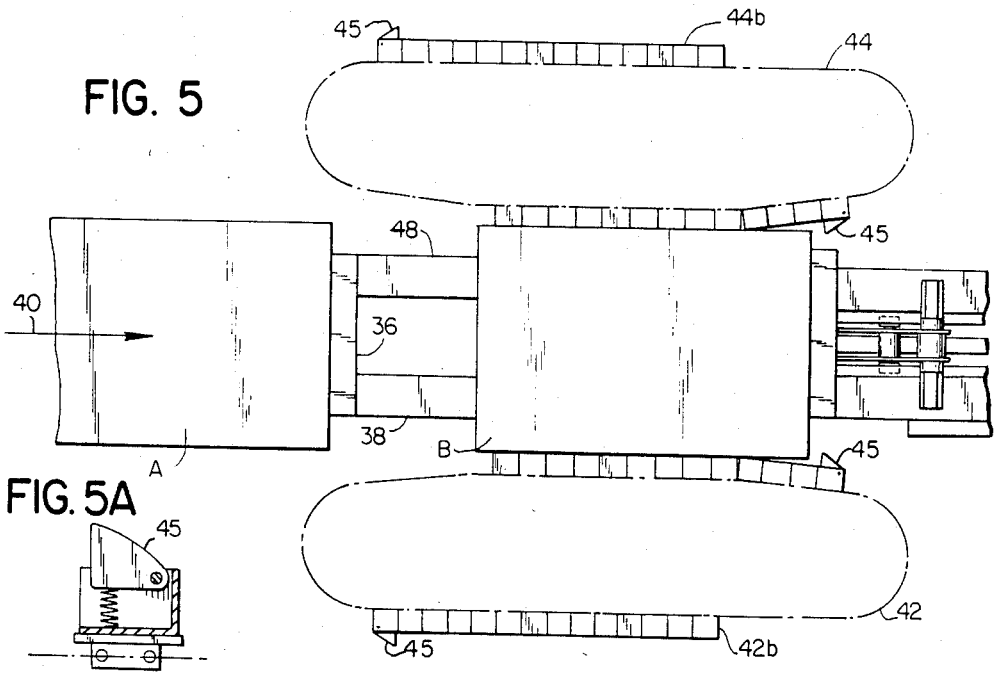
FIG. 5A
FIG. 6
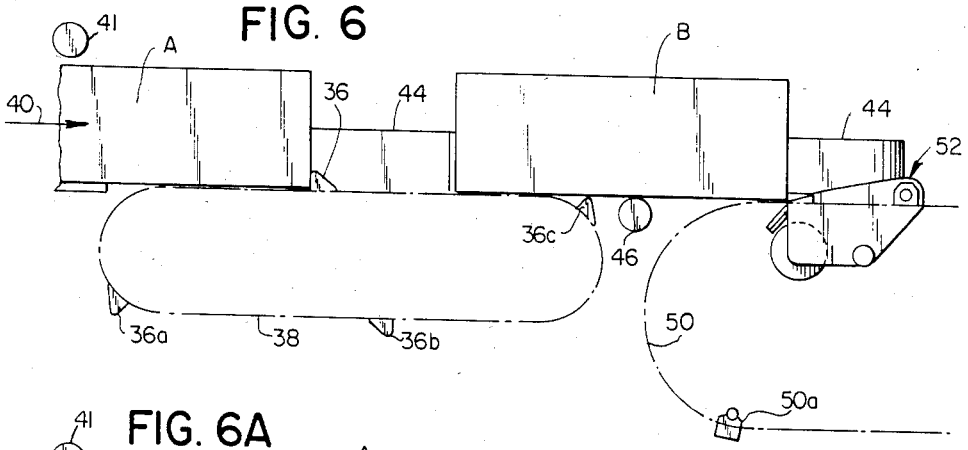
FIG. 6A
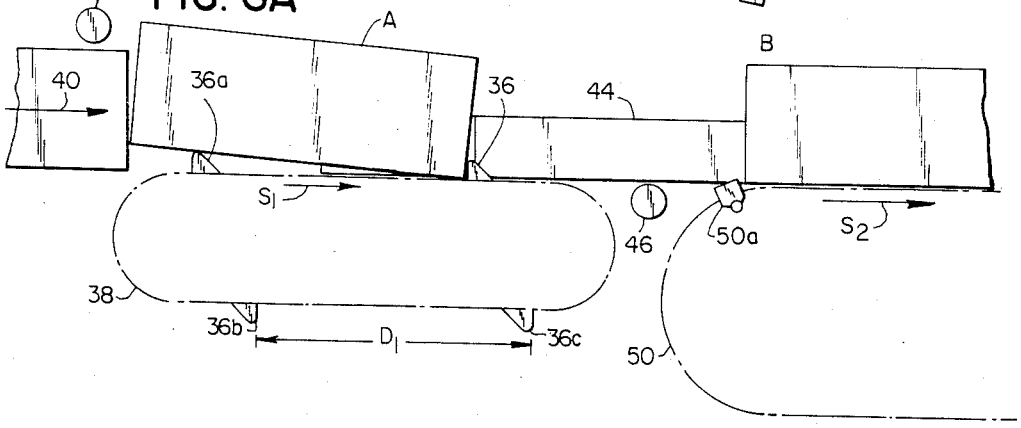

FIG. 10
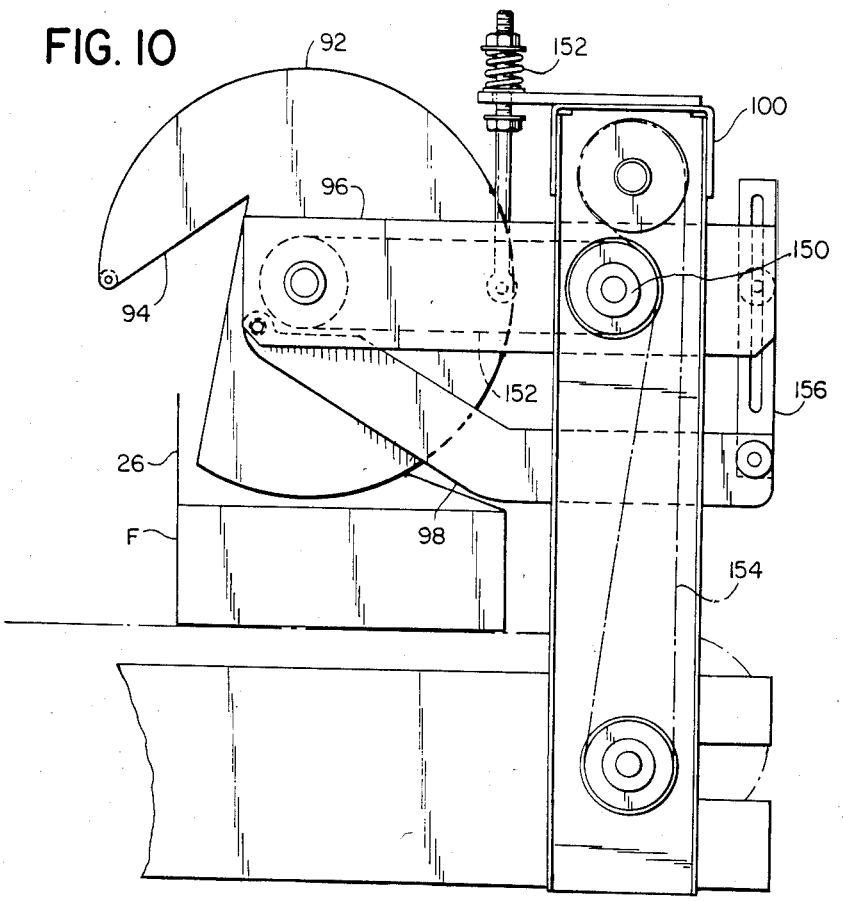
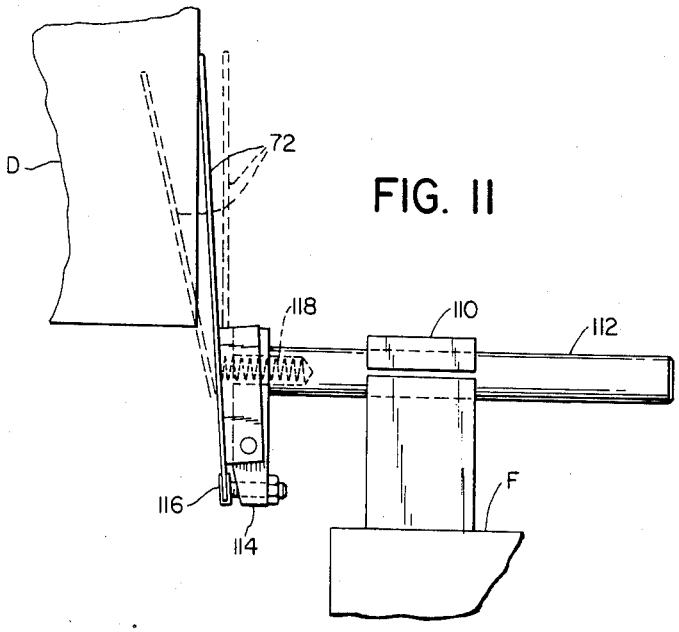
FIG. 11

PACKING CASE TAB SLITTER

CROSS REFERENCE TO RELATED APPLICATION

This application is a division of Ser. No. 254,638, filed Apr. 16, 1984, which was a division of Ser. No. 075,324, filed Sept. 12, 1979 now U.S. Pat. No. 4,291,518 issued Sept. 29, 1981.

BACKGROUND OF THE INVENTION

Bottles, or other containers, are often packaged in cardboard packing cases of the type having interconnected top flaps at diagonally opposite corners of the case to hold the top flaps close to the sides of the case during case loading.

The top flaps of the loaded cases must then be closed, and this requires that these tabs be slit before the top flaps can be moved away from the sides of the case. Prior art patents related to such tab slitting apparatus generally teach that the case must be rotated 90 degrees between the slitting of the rear tab and the front tab, at least where the slitting knife is stationary, and the case moves past the fixed knife as shown for example in U.S. Pat. Nos. 3,373,543, 3,533,214, 3,559,368, 3,726,061, and 3,733,772. U.S. Pat. No. 3,387,522 illustrates a straight line path for such a case in a tab slitter, but this patent requires that at least one knife be movable rather than stationary.

The chief aim of the present invention is to provide apparatus for slitting the diagonally opposite top flap connecting tabs of a packing case wherein the case moves straight through the apparatus past the fixed knives, without necessity for rotating the case on a vertical axis to slit the leading tab. Other advantages to the present invention will be apparent, particuarly in response to the infeed means for spacing the cases to be slit, and the top flap folding means provided downstream of these fixed tab slitting knives.

SUMMARY OF THE INVENTION

This invention relates generally to apparatus for slitting diagonally opposite top flap connecting tabs which hold the top closure flaps of a packing case alongside the sides of the case, and deals more particularly with an apparatus which includes fixed knives for slitting these tabs as the case moves in a straight line. The apparatus includes novel means for separating the cases to be slit at the infeed end of the apparatus, and also includes means for raising the front and rear down folded top flaps after these tabs are slit.

In its presently preferred form the apparatus for severing the connecting tabs at diagonally opposite corners of an upwardly open packing case comprises means defining a straight line path through the apparatus, said path being more particularly defined by a variable speed infeed flight bar conveyor which cooperates with sides belts for spacing the cases and moving them into an associated pocket chain conveyor to carry each case through the apparatus. Each case has a generally rectangular shape, being of flexible cardboard construction with a bottom, opposed side walls connected to front and rear end walls, and having side, front and rear top flaps folded downwardly alongside these side, front and rear walls respectively. These top flaps are held in place by two diagonally opposite top flap connecting tabs for ease in loading or filling the packing case, but these tabs must be slit in order to permit closing of the case.

The apparatus includes means for conveying cases in a horizontal downstream direction so that one of the connecting tabs is at the forward end of the case and the diagonally opposite tab at the trailing end of the case. Means is provided for canting or raising the forward end of the packing case so that at least one forward corner and preferably the opposite rear corner of the case associated with the two connecting tabs is gradually lifted in order to facilitate entry of a fixed guide plate between the top flap associated with one of the case side walls and the top flap associated with that particular side wall. The trailing or rear connecting tab is severed by a fixed knife associated with a case guiding means located on the opposite side of the case conveying means and the means for raising the forward end of the case also serves to lower the case downwardly onto a second fixed knife associated with the case guiding means first above mentioned in order to sever the leading connecting tab of the case as the case is so lowered.

The means for conveying the case through this portion of the apparatus preferably comprises a pocket chain conveyor including two generally parallel chains with upper runs defining the path for the cases as they move downstream. A rear case pusher flight bar defines the trailing side of each pocket, and a front flight bar is pivotally supported by these chains and includes a case engaging portion for engaging the forward bottom end of the case to raise the case upwardly as described previously. A fixed cam track is associated with the forward flight bar for this purpose, and this flight bar has a case engaging portion which defines the forward edge of the pocket for the case. The case is not only raised in this manner, but is also tilted slightly by reason of the case engaging portion having a non-horizontal configuration. Furthermore, the path for the parallel conveyor chains may itself be altered such that the rear end of the case is tilted in the opposite direction in order to increase the separation between the top closure flaps and the side walls of the case at those corners without connecting tabs.

Novel case infeed means is provided at the upstream end of the apparatus for accepting a line of cases arranged end-to-end such that these cases may be advanced by line pressure toward the infeed station of the apparatus. The infeed station includes a flight bar conveyor means having parallel chains and transverse flight bars defining a portion of the path for the case in which these flight bars and chains initially move at a speed slower than that of the advancing cases, and also slower than the speed of the cases advancing on the pocket chain conveyor. These infeed flight bars are spaced apart by a distance which is less than the longitudinal dimension of the case being handled so that each case has its trailing end lifted prior to accelerating that case up to the speed of the pocket chain conveyor. The infeed conveyor and the pocket chain conveyor are synchronized with one another to provide cases to be slit in the pockets of the case conveyor so that the above decribed fixed slitting knives can slit the tabs of the case as the case moves downstream.

The apparatus also includes novel means for raising the downfolded closure flaps, particularly the front and rear top closure flaps at the downstream end of the apparatus. Transversely opposed flap folding chains are provided on either side of the case path, said chains being entrained on sprockets which rotate on axes tilted with respect to the vertical so that these chains have parallel runs which are inclined with respect to the horizontal path of the case through the apparatus. Front and rear top flap engageable tuckers are provided on each of these chains, respectively, and project into the path of the cases as these flap tuckers move upwardly and in the downstream direction on their associated horizontally inclined chains. Once these front and rear top flaps have been moved away from the vertical end walls of the case by a sufficient angular displacement a rotating wheel is provided so that its periphery folds the front top flap onto the top of the case, and this wheel has a notch suitable for down folding the rear flap as well.

BRIEF DESCRIPION OF THE DRAWINGS

FIG. 1 is a perspective view illustrating an apparatus which incorporates the present invention, the cases being adapted to move from left to right through the machine of FIG. 1. That is, the left-hand or upstream end of the apparatus of FIG. 1 is adapted to receive cases fed thereto by line pressure, with the cases arranged in end-to-end relationship. Cases are discharged from the downstream, or right-hand end of the apparatus of FIG. 1 with the top flap connecting tabs slit, and with the top front and rear closure flaps folded inwardly over the top of the case ready for gluing and final folding of the top side flaps at another station (not shown).

FIG. 5 is a plan view of the infeed station associated with the apparatus of FIG. 1 being drawn to the same scale as FIGS. 3A and 3B above.

FIG. 5A is a detailed view of one of four spring biased abutments as used on the side chains of FIG. 5.

FIG. 6 is side elevational view of the infeed station depicted in the plan view of FIG. 5, and is also drawn to the same scale as that of FIG. 4A.

FIG. 6A is a elevational view of the apparatus of FIG. 6 but taken at a slightly later instant of time.

FIG. 10 is a side elevational view of the discharge end of the apparatus illustrated in FIG. 1, showing in more detail the mounting for the rear top flap tucking wheel and associated guide rail at the right hand end of FIG. 4B.

FIG. 11 is a detail view of one of the mounting devices for the side guides or plates upon which the tab slitting knives are provided, the broken lines illustrating limit positions for the guide plate to either side of the cage engaging position shown in full lines.

Figure 9:
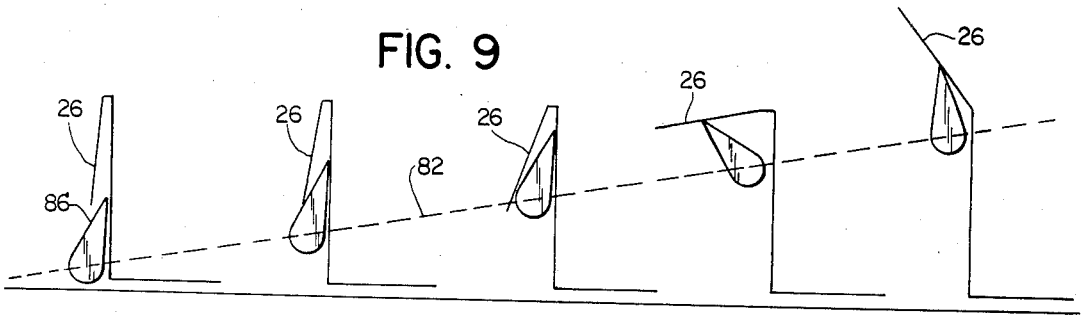
FIG. 9 is a view similar to FIG. 8 illustrating the other of said two inclined side mounted chain conveyors, for unfolding the rear top flap so that it and the front top flap can be final folded by the rotating wheel illustrated at the downstream end of the apparatus of FIG. 1 and in FIG. 10.
Figure 12:
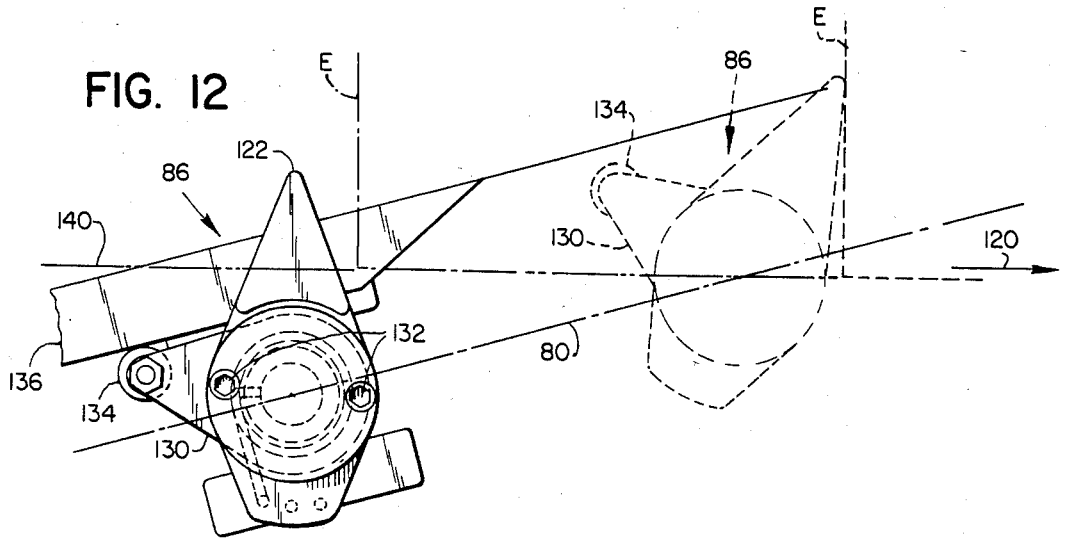
Figure 12B:
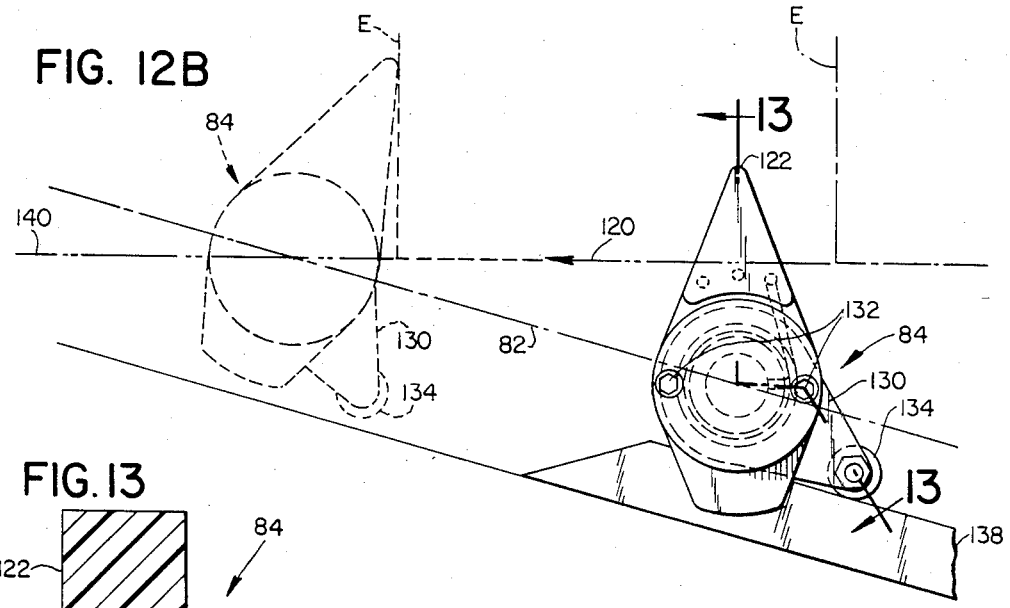

FIG. 12 is a side elevational view of two positions for the rear top flap tucker at a slightly earlier stage than ilustrated in FIG. 9, and shows this cam operated flap tucker locating the case between it and the rear top flap tucker, FIG. 12B shows the rear top flap tucker performing the same function and is a mirror image of FIG. 12 except for the fact that the case moves from left to right in FIG. 12, and from right to left in FIG. 12B.

Figure 13:
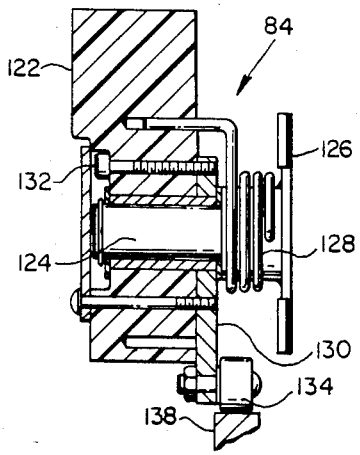

FIG. 13 is a sectional view of one flap tucker, being taken on the line 13—13 of FIG. 12B.

Figure 14:
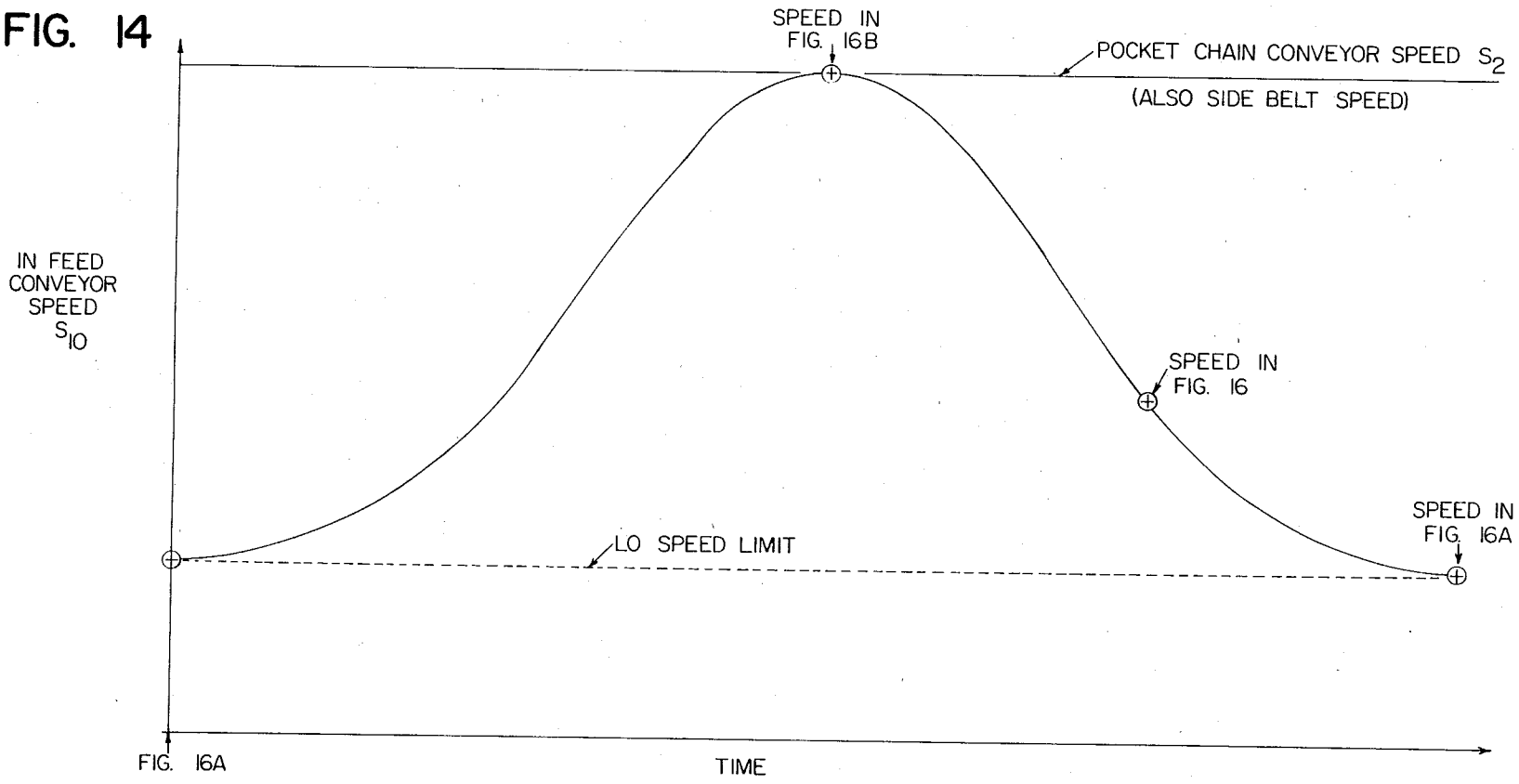
Figure 15:
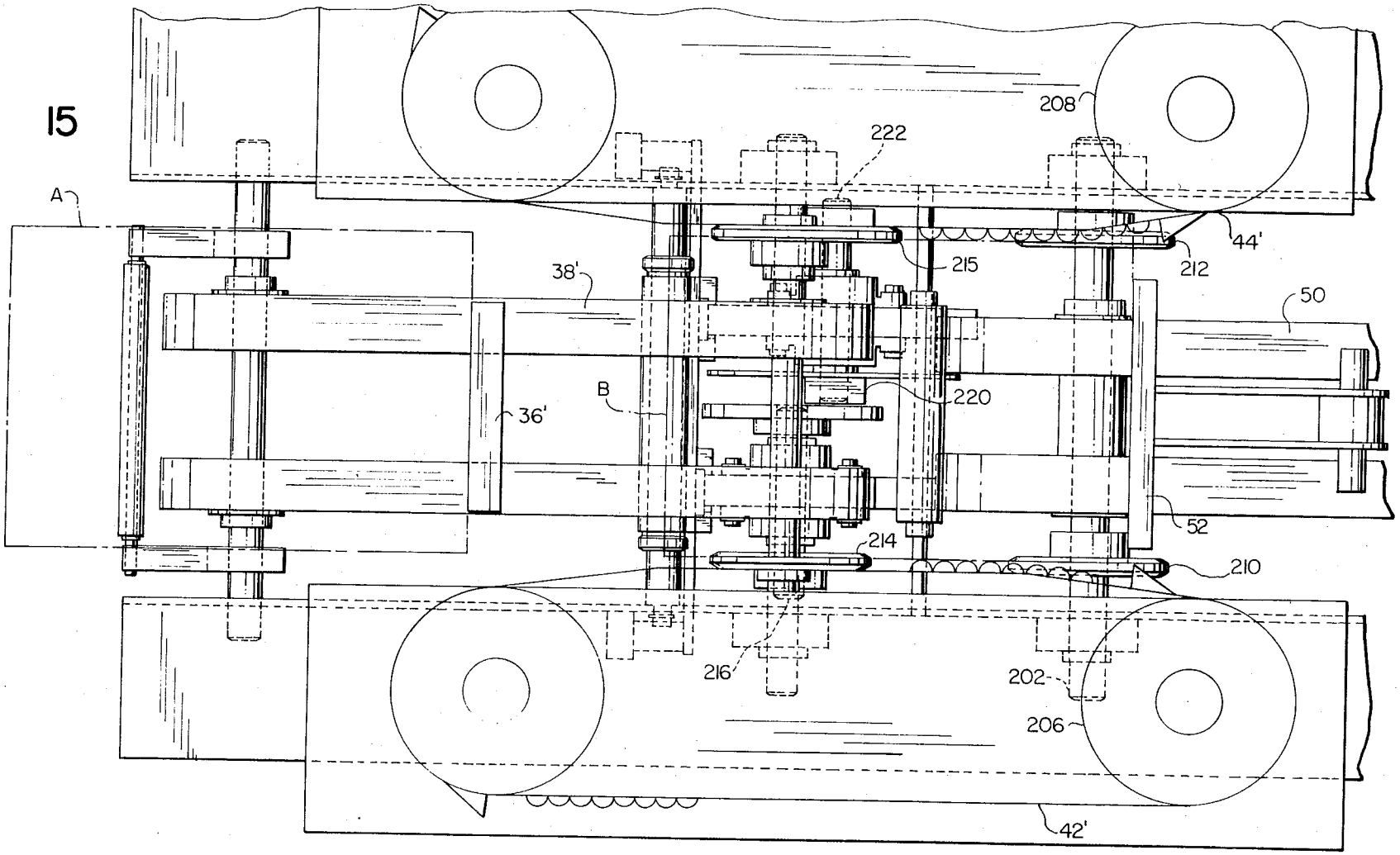
Figure 16:
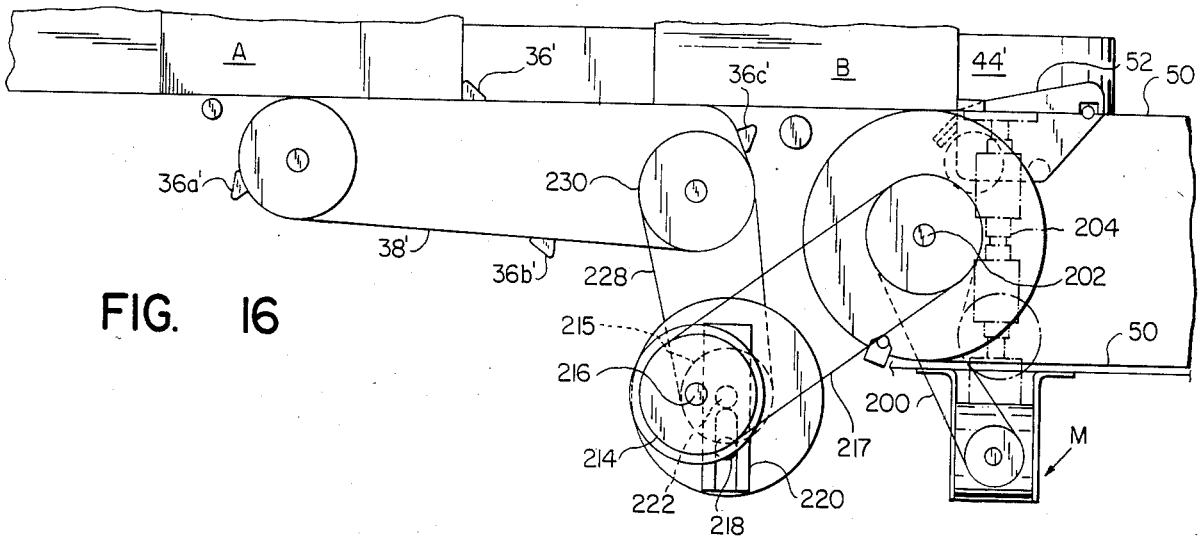
Figure 16A:
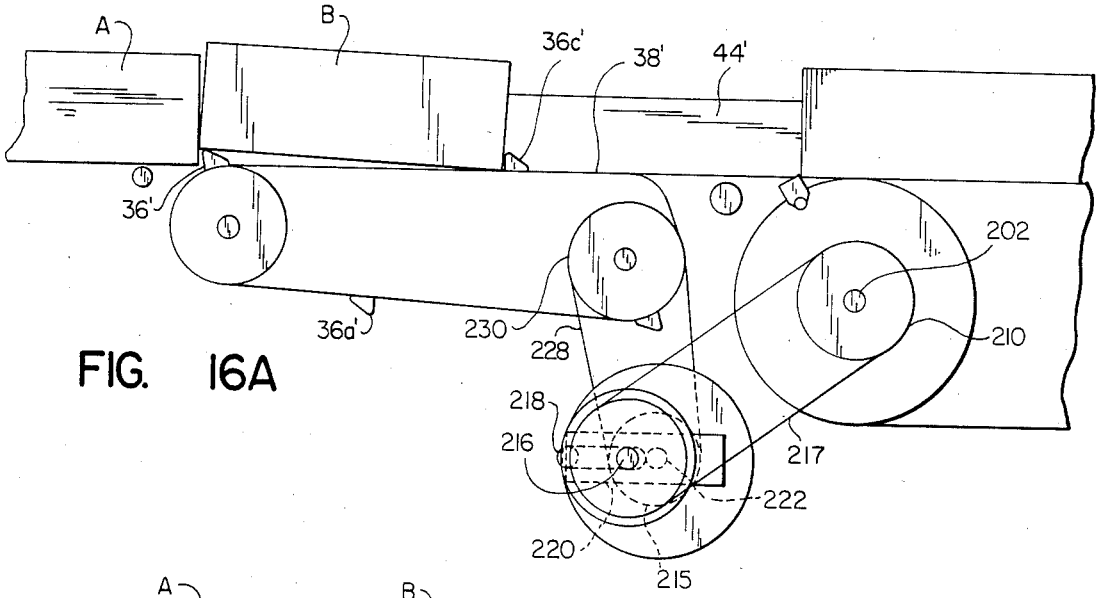
Figure 16B:
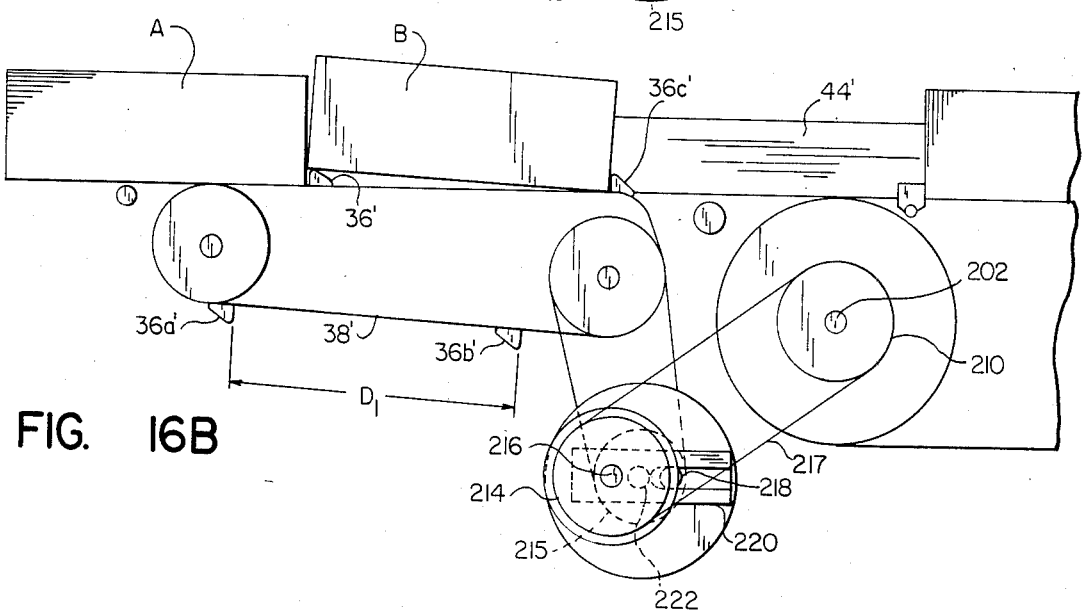

FIG. 14 is a graphical plot of infeed conveyor speed S10 vs time and illustrate the cyclical variation of that parameter, by reference to the constant speed S2 of the pocket chain conveyor, in an alternative embodiment of infeed conveyor as shown in detail in FIGS. 15–16B.

FIG. 15 is a detailed plan view of the infeed station in an alternative embodiment for the infeed conveyor of the type shown in FIG. 5, and suitable for use in place of that described with reference to FIGS. 6 and 6A in an apparatus of the type shown in FIGS. 1–4A and FIGS. 7–13 inclusively.

FIG. 16 is a side elevational view of the infeed station depicted in FIG. 15.

FIGS. 16A and 16B show the infeed station of FIG. 16 at different points in time as illustrated graphically in FIG. 14.

DETAILED DESCRIPTION OF FIGS. 1–13 INCLUSIVELY

Figures 1, 2, 3, 3A, 3B, 4, 4A, 4B:
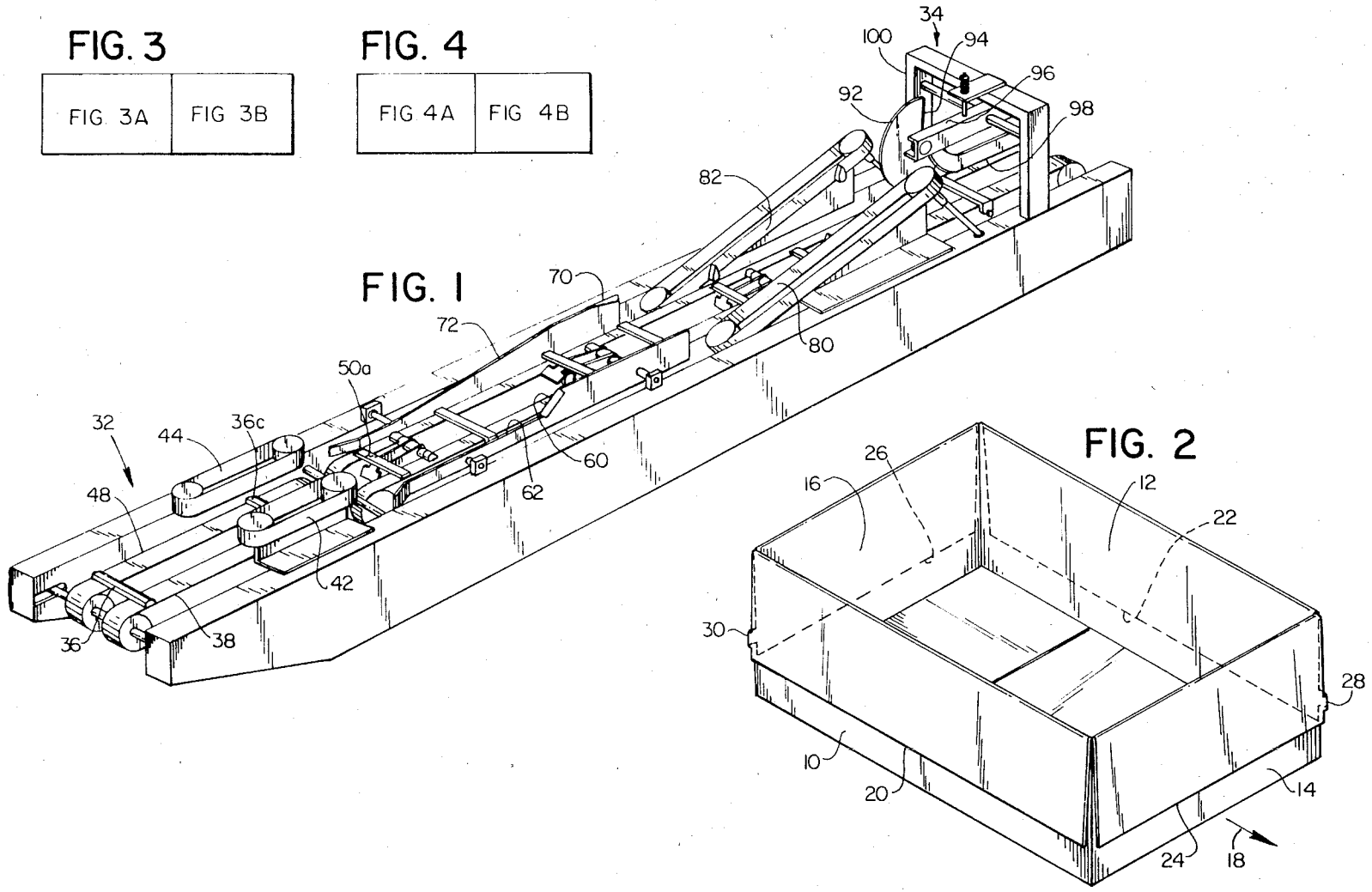
FIG. 2 is a perspective view of a typical packing case illustrating the condition of the case as received at the upstream or infeed end of the apparatus of FIG. 1 (except that no load of bottles or the like is shown in th case in order to better reveal the various parts of such a conventional packing case).
FIG. 3 is a composite of FIGS. 3A and 3B.
FIGS. 3A and 3B are plan views of portions of the FIG. 1 apparatus and can be placed end-to-end as suggested in FIG. 3.
FIG. 4 is a composite of FIGS. 4A and 4B.
FIGS. 4A and 4B are side elevational views of portions of the FIG. 1 apparatus and can be placed end-to-end as suggested in FIG. 4.
Figure 3A:
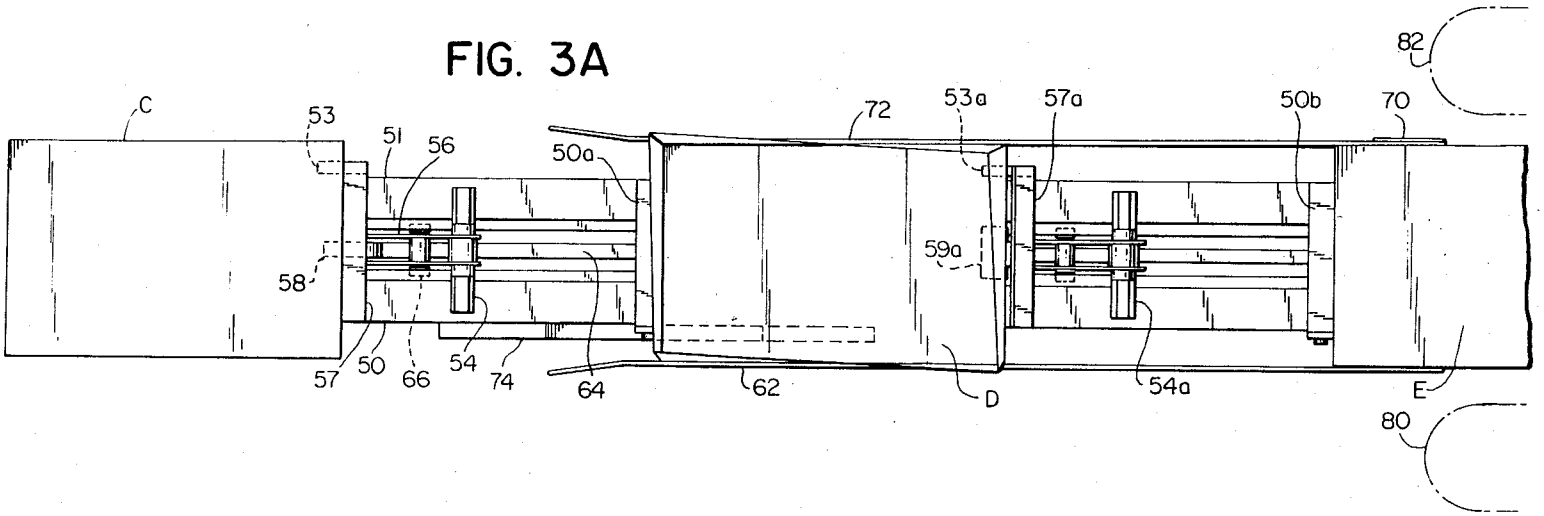
Figure 4A:
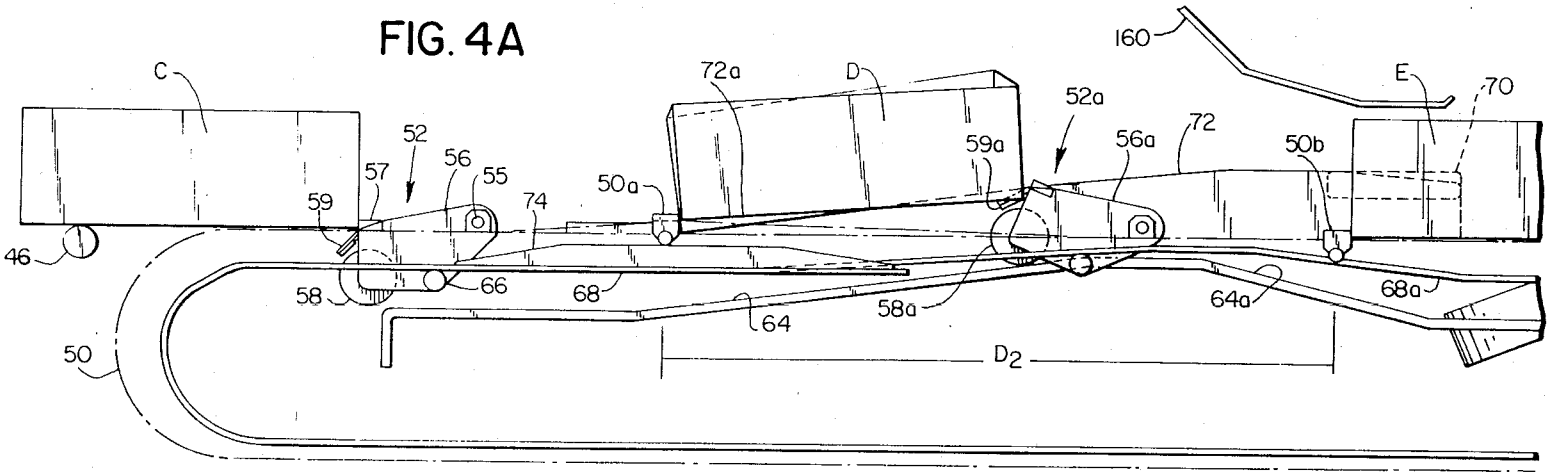
Figure 3B:
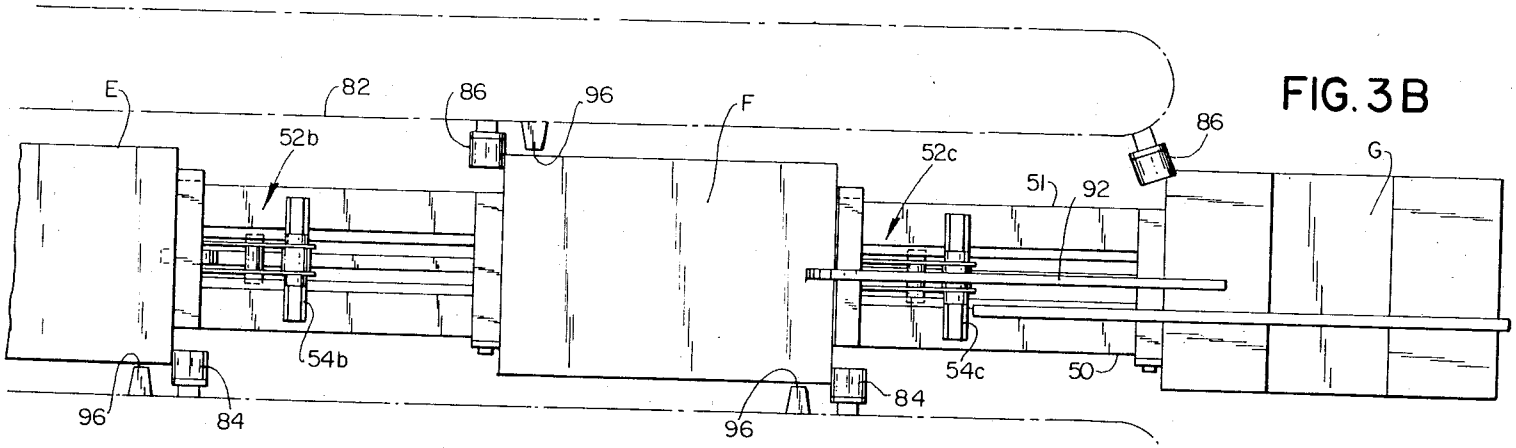
Figure 4B:
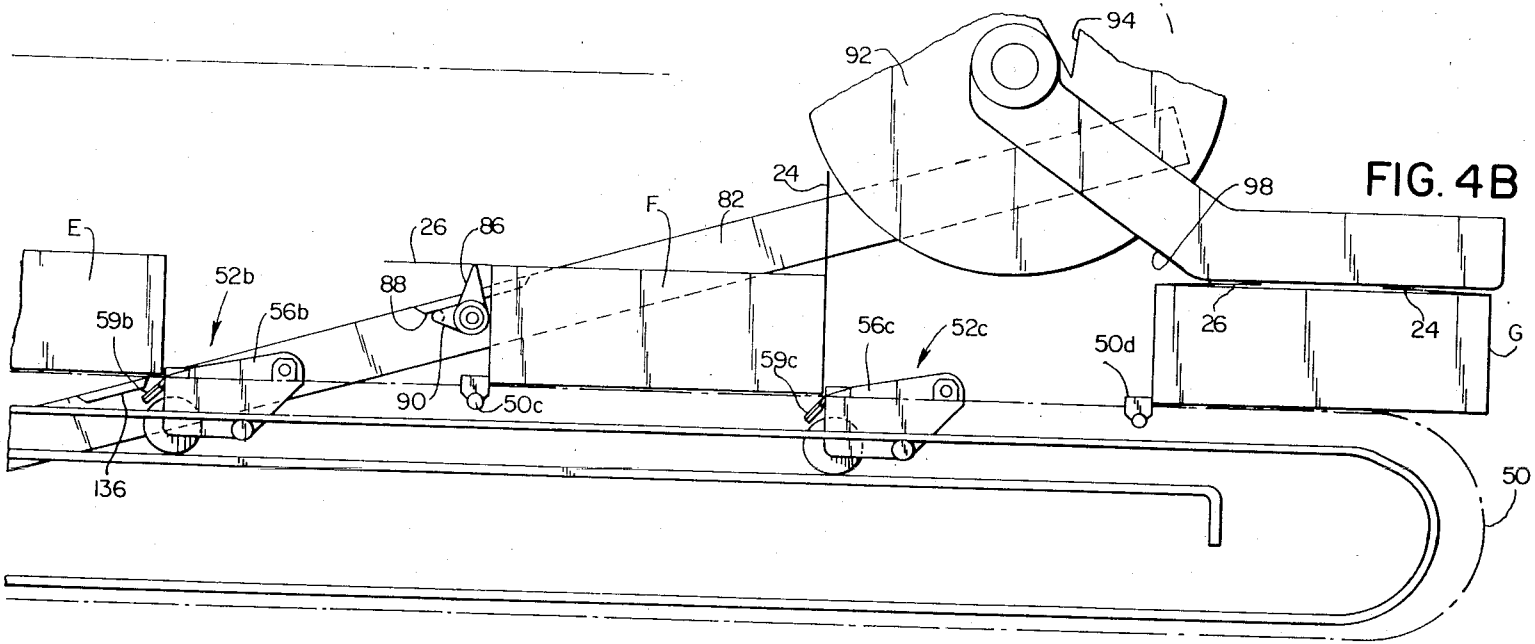

Turning now to the drawings in greater detail, FIG. 2 shows a tab lock case in its erected configuation suitable for handling in an apparatus of the type illustrated in FIG. 1 but for the fact that the upwardly open case of FIG. 2 would be provided with product, such as beverage bottles or the like, in a packer (not shown) from which packer the filled cases would be fed on rollers, or on an underlying belt type conveyor (not shown) to the upstream end of the apparatus as illustrated at the left-hand side of FIG. 1.

Each such tab lock case is formed from a slotted container blank secured at opposite ends to provide the case in a collapsed tubular form. Each case includes four interconnected side and end walls 10, 12, 14 and 16. In th apparatus of FIG. 1, to be described, reference numeral 14 will be referred to as the forward or front end wall as suggested by refernce to the arrow 18, and the opposite end wall 16 will be referred to as the trailing or rear end wall. The bottom flaps will have been folded into place and suitably glued or otherwise secured by conventional means prior to th case being loaded in the packer, and the top closure flaps 20, 22, 24 and 26 are hinged to the upper edges of the side and end walls 10, 12, 14 and 16 in conventional fashion.

These top closure flaps 20, 22, 24 and 26 are held in down-turned relationship, alongside their associated side and end walls by integrally formed connecting tabs 28 and 30 provided at diagonally opposite corners of the case and serving to interconnect the front and left-side closure flaps 24 and 22 as indicated at 28 in FIG. 2. The tab 30 is provided at the diagonally opposite rear corner of the case to hold rear and side top closure flaps 20 and 26 in place as shown.

Cases of the type shown in FIG. 2 are well adapted for high speed filling or packing in conventional case packers, and the top closure flaps are held in place alongside the side and end panels of the case so as not to interfere with the funnel mechanism and other components of the packer during the case filling operation. Further, the tabs 28 and 30 can be formed in the intially flat carton blank, which blank can be erected to the configuration shown without necessity for slitting these tabs, greatly facilitating the packing operation. Once the cases have been filled or packed they are moved to a machine of the type shown in FIG. 1 as for example on an underlying belt type conveyor which exerts a frictional force on the underside of the filled case to advance them by line pressure toward the infeed station, indicated generally at 32 in FIG. 1. The apparatus of FIG. 1 is designed to slit the flaps 28 and 30 of the case shown in FIG. 2, and to raise at least the top and rear closure flaps 24 and 26 from the positions shown in FIG. 2, and as suggested in FIGS. 8 and 9, such that these flaps can be moved inwardly and over the contents of the case preparatory to gluing or the like. The discharge end of the FIG. 1 apparatus indicated at 34, provides the cases in this configuration, and with the side closure flaps 20 and 22 retained in the position shown in FIG. 2 such that the case flap can then be conveniently glued and otherwise secured for further processing.

The apparatus of FIG. 1 provides for the continuous flow of the filled cases from left to right in FIG. 1 and generally in the other views to be described below. Incoming cases are advanced to the infeed station 32 of the FIG. 1 apparatus by line pressure, that is with the cases arranged in end-to-end relationship and means is provided at the infeed station for separating these packing cases by slowing their progress as a result of the cases engaging one of the flight bars 36, 36 of an infeed flight bar conveyor 38, which conveyor has an upper run aligned with the bottoms of the cases. As so oriented, the conveyor 38 can conveniently receive each case, as for example the case A in FIG. 6, and slow the case, the backup of cases being advanced in the direction of the arrow 40, and providing a separation between the case A and its predecessor, case B in FIG. 6.

The spacing D1 of the flight bars 36, **36*a*, 36*b* and 36*c* on the infeed conveyor 38 is significantly shorter than the length L of the cases being handled (A, B in FIG. 6) with the result that each case entering the infeed station of the apparatus will be lifted slightly as suggested in FIG. 6A in addition to being decelerated on the infeed conveyor 38 as mentioned previously. When the case A of FIG. 6A has advanced forwardly so that the flight bar 36 moves downwardly out of the path of travel for the leading edge of the case, the case will be accelerated by auxiliary means in the form of side belt or side chain conveyors 42 and 44 in FIG. 5. Each side belt conveyor has a pair of pads, 42*a* and 42*b* for the right-hand accelerating side belt 42, and these side belts act on the opposite sides of the case B to move that case into an associated pocket on a pocket chain conveyor 50 to be described. The relative speeds associated with the infeed conveyor 38 and the auxiliary side belt conveyors 42 and 44 is related to the spacing between the flight bars 36 through 36*c* inclusively on the infeed conveyor 38 and the spacing associated with the pockets on the pocket chain conveyor 50 because of the fact that the auxiliary side belt conveyors 42 and 44 are driven at a speed equal to that of the pocket chain conveyor 50. Further, each of these conveyors is synchronized with respect to the other so that the rear pusher flight bar 50*a* associated with the pocket chain conveyor 50 engages the rear end of the case B as shown in FIG. 6A in order to move that case downstream through the apparatus of FIG. 1 at a speed (S2) which is related to the speed of the infeed conveyor 38 (S1) in accordance with the relationship between the spacing (D2) between the flight bar pushers on the pocket chain conveyor 50 and that of the flight bars on the infeed conveyor 38 (D1). The spacing D2 for the pockets on the pocket chain conveyor 50 is best shown in FIG. 4A, which figure is drawn to the same scale as FIG. 6A, which illustrates the spacing D1 for the flight bars on the infeed conveyor 38**.

The infeed conveyor 38 and the pocket chain conveyor 50 combined to define a straight line path for the cases being handled in the apparatus of FIG. 1, and the gap between these conveyors may be such in relationship to the length of the case being handled that a roller 46 may be used between them to further control the case being accelerated from the relatively slow speed infeed conveyor 38 to the pocket chain conveyor 50. The case B of FIG. 5 has been stopped short of the latches or abutments 45, 45 at the leading edge of both side chain pads **42*a* and 44*a* because the flight bar 36*c* (FIG. 6) had successfully "stopped" this case relative to the underlying conveyors 38 and 48. If a flight bar 36 should fail to so "stop" a case, these latches or abutments 45, 45 will avoid premature entry of the case into pocket chain conveyor 50. Further, a roller 41 is preferably provided above the case A approaching conveyor 38 to help prevent premature entry of cases to conveyor 38. FIG. 5A shows one abutment 45, and the fact that this abutment is able to retract should it engage the sides of a case on the infeed conveyor 38/48**.

As best shown in FIG. 1 and in FIG. 5 the infeed conveyor 38 comprises at least one and preferably two parallel chain conveyors 38 and 48 which support the ends, respectively, of flight bars, 36 through **36*c* inclusively, at spaced locations around the periphery of the chains. This spacing D1 is such that each case is held up, as described with reference to FIG. 6, and raised slightly as suggested in FIG. 6A, with the result that when the flight bar passes around the downstream end of the infeed conveyor 38 the case will be accelerated by the sides chains 42 and 44 and more particularly by the pads 42*a* and 44*a* in order to assure that the speed of the case matches that of the pocket chain conveyor 50. The pocket chain conveyor 50 has rear or pusher flight bars as shown at 50*a* in FIGS. 6 and 6A which are synchronized with motion of the infeed conveyor 38 so as to assure that the case B is received in a pocket of the pocket chain conveyor for further movement downstream in this straight line path through the apparatus, as best shown in FIGS. 3 and 4. Not only is the infeed conveyor 38 so timed and synchronized as to release a case into the pocket chain conveyor 50** in this manner, but it is also advantageous to be able to shut down both conveyors at a particular point in this cycle, as for example if there are not enough cases being advanced by line pressure into the infeed station itself.

A solenoid operated clutch/brake unit is preferably provided in the drive for the infeed conveyor 38, and is controlled by a cam operated limit switch on the drive for the pocket chain conveyor so that stopping the conveyors can only occur when the side belts or chains 42 and 44 have their case engaging pads 42*a*, 42*b* and 44*a*, 44*b* out of contact with the cases. This prevents scuffing of these cases upon shut down and/or start-up.

The side chains 42 and 44 are driven by the same drive as that for the pocket chain conveyor 50, and operate at the same speed (S2). The spacing between the pads 42*a* and 42*b* (or 44*a* and 44*b*) is also identical to that of the pushers 50*a*, 50*b* etc. on the pocket chain conveyor 50 (see dimension D2 in FIG. 4A for this parameter).

Turning next to a more complete description of the pocket chain conveyor 50 depicted in detail in FIGS. 3A, 3B and 4A, 4B; the packing cases are fed into pockets defined by the conveyor 50 of FIGS. 3 and 4 as shown for example by the carton indicated at C in these views. The pocket chain conveyor comprises parallel chains 50 and 51 best shown in FIG. 3A each of which have upper generally horizontal runs defining a path for the cases, which path is in line with the path taken by the cases both during advance to the infeed station, and also during slow down on the infeed conveyor 38. As will be described the pocket chain conveyor comprises convenient means for conveying cases in a horizontal downstream direction so that the connecting tabs 28 and 30 at the forward end and trailing end respectively of the case can be conveniently severed by fixed knives 60 and 70, best shown in FIG. 1. Means is provided for canting the moving case as it advances downstream on the pocket chain conveyor, and preferably said means includes the capability of also tilting the case, as best shown in FIG. 4A by the case D, so that inclined guide plates 62 and 72 associated with each of the knives 60 and 70 respectively will easily enter the limited space provided between the down-turned side closure flaps 20 and 22 of the packing case in order to properly orient and locate the case for slitting of the tabs 30 and 28 respectively. The left hand guide plate 72 has its upper edge 72 oriented at a shallow incline, preferably more shallow than the inclination of the adjacent side panel of the case itself in its canted position (see FIG. 4A), so that this spring loaded guide plate (see FIG. 11) will locate itself between the case side panel and the top side flap as a result of yieldingly engaging the case side wall.

FIG. 11 shows in detail one of at least two of the side guide mounting brackets for each of the guides 72 and 62 (best shown in FIG. 1). The machine frame F has a block 110 mounted thereon, and adapted to adjustably clamp a rod 112. The inner end of the rod 112 has a depending arm 114 which carries a support 116 for the lower longitudinal edge 116 of guide plate 72 such that the plate is flexibly supported at this edge for limited flexing motion between the limit positions illustrated in broken lines in FIG. 11. When a case D is moved between the guide plates 62 and 72 these plates center the case therebetween, assuming a position such as that shown in full lines in FIG. 11. A compression spring 118 is provided in a cavity at the end of rod 112 to bias the guide plate 72 inwardly toward the side panel of the case D as shown.

Each pocket on the pocket chain conveyor 50 includes a rear pusher flight bar 50*a*, 50*b*, 50*c* and 50*d*, which flight bars are disposed transversely of the chains 50 and 51 and which flight bars are timed with respect to the motion of the infeed conveyor 38 as described above in accordance with the relationship $S1/S2=D1/D2$ where S1 is the speed of the infeed conveyor, D1 is the spacing between the flight bars 36, 36*a*, 36*b* etc. of the infeed conveyor, S2 is the speed of the pocket chain conveyor, and D2 is the spacing between the rear case pusher flight bars 50*a* through 50*d* inclusively. The leading end of each pocket defined on the pocket chain conveyor for transporting a case therein preferably comprises a leading or pivoted front flight bar, 52, 52*a*, 52*b*, and 52*c* in FIGS. 3 and 4, which front flight bars include a transverse member 54 attached at opposite ends to the flight bar chains 50 and 51 and defining a transverse pivot 55 for pivoted bellcrank means 56. The said bellcrank means provides a convenient means movable with the case, and has a trailing portion 57 engageable with the forward end of the case, to raise the case as suggested by the case D in FIG. 4A. Pivotal motion of the bellcrank means 56, as a cam follower roller 58*a* rides upwardly on a fixed cam track 64 best shown in FIG. 4A achieves this case canting or raising of its forward end. The case engaging portion 57 including a trailing tine 59 carried by the cross piece 57 such that the underside of the case D is engaged by this tine 59 and a laterally spaced tine 53 best shown in FIG. 3A is provided at a slightly higher elevation than the tine 59 so that the case is not only raised or canted, but is also tilted in that the front end panel of the case is cocked slightly with respect to its rear panel in order to provide that corner of the forward end of the case with the connecting tab 28 at a height greater than the other forward corner of the case.

Still with reference to the forward flight bar configuation defining the leading edge of the pockets on the pocket chain conveyor 50, each of these mechanisms, 52 through 52*c* inclusively in FIGS. 3 and 4, also includes a second cam follower means 66 comprising a pair of parallel rollers, best shown in FIG. 3A, which rollers engage the underside of a cam track 68 in order to positively control the angular configuration of the bellcrank means described above, not only during the raising or canting of the case as shown at D in FIG. 4A, but also for assuring that the case moves downwardly back to its horizontal position in line with the direction of motion of the case through the machine as indicated at E in FIGS. 3 and 4. The cam tracks 68 and 64 have downstream segments 68*a* and 64*a* which act on the rollers, 66 and 58 respectively to assure that the case is positively lowered from the canted and tilted position shown at D in FIG. 4A to the position shown at E in that view.

Figure 7:
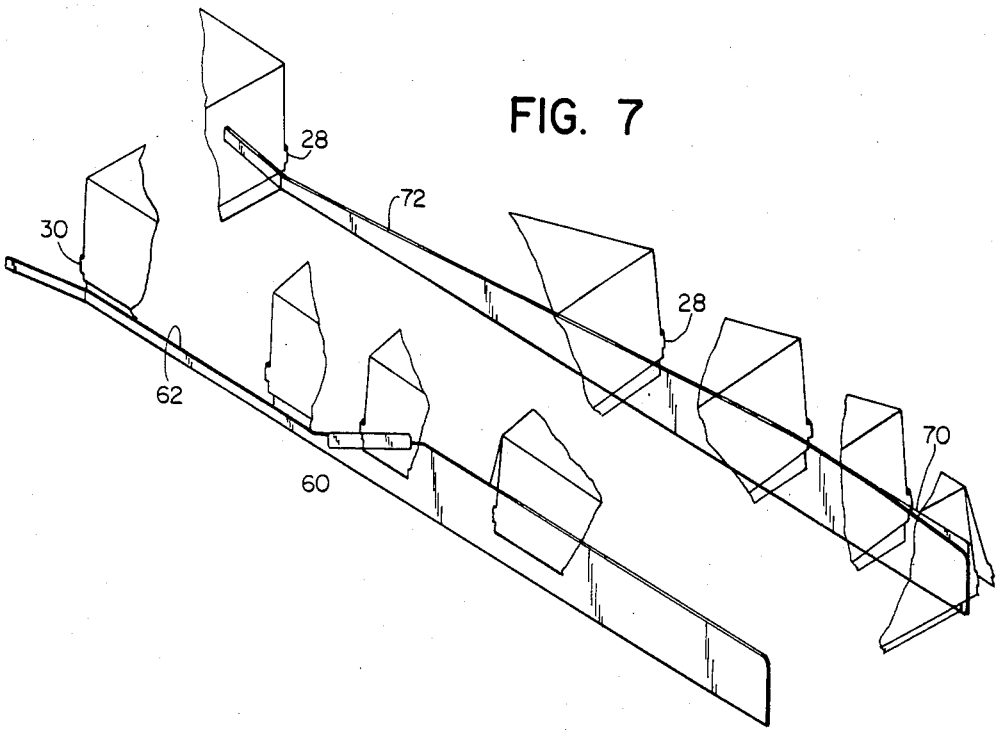
FIG. 7 is a schematic view to illustrate the succession of positions for a typical packing case as it moves in line through the apparauts of FIG. 1 past the fixed knives associated with the trailing and rear connecting tabs which hold the top flaps of the case in place, as shown in FIG. 2.

The spring biased side guides 62 and 72 are fitted with knives 60 and 70, which knives are so arranged that the connecting tabs 30 and 28 are severed (substantially simultaneously) during the above described motion of the case. The trailing tab 30 is severed by the knife 60 as best shown in FIG. 7, and the leading corner tab 28 is severed by the knife 70 at the opposite side of the case path when the case is lowered from its canted and tilted position. The sequence of views illustrated in FIG. 7 for each of the two diagonally opposite corners of the case provided with the connecting tabs illustrates this tab slitting operation. In order to supplement the tilting action of the non-horizontal tines 59 and 53 associated with the forward flight bar 52 on the pocket chain conveyor, means is provided for tilting the rear panel of the case in the opposite direction while the case moves through the machine and at the same time that the forward panel is tilted by the forward flight bar.

To accomplish this supplemental twisting action of the case, a fixed ramp 74 is provided beneath the right-hand flight chain 50 with the result that the rear pusher flight bar 50*a* in FIG. 4A is lifted as shown by the packing case D in that view. The position of the ramp 74 is so located longitudinally with respect to the inclined tab slitting blade 60 that the blade enters cleanly between the side top closure flap 20 of the case and the side panel thereof as a result of the spring biased guide 62 and the trailing connecting tab 30 is severed by blade 60 without any interference between the blade 60 and the case itself. Although the near guide plate 62 is not shown in FIG. 4A the opposite guide plate 72 is shown, and can be seen to have its inclined portion 72*a*, discussed previously, which assures that this guide plate slides between the top closure flap 22 and its associated side panel of the case D, with the result that the case will be properly positioned so that upon dropping the forward end back to the horizontal position on the pocket chain conveyor, blade 70 cleanly severs the tab 28, as shown graphically in FIG. 7.

The pocket chain conveyor 50 serves to advance the packing case beyond the tab slitting station just described, and through a top flap lifting or folding section provided immediately downstream thereof, and finally to discharge the case as shown by the position of case G in FIG. 4B. As discharged the case G will have its front and rear top closure flaps 24 and 26 folded inwardly over the top of the case, but it is a feature of the present apparatus that the side top closure flaps 20 and 22 are caused to remain folded alongside the side panels 10 and 12 of the case in order to provide a configuration well suited to gluing at a subsequent station in the packaging line (not shown).

Figure 8:
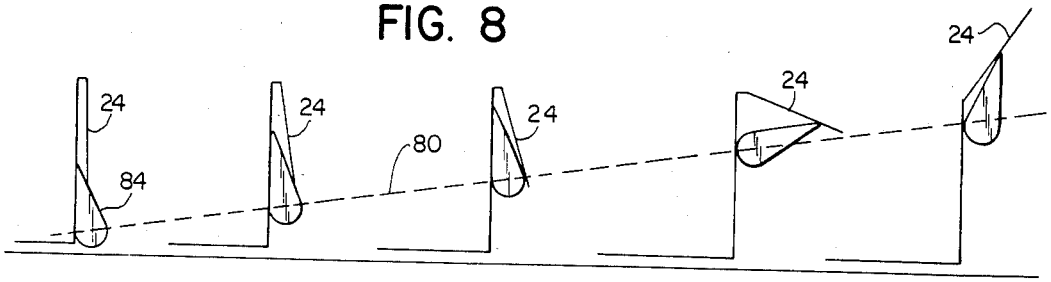
FIG. 8 is a series of successive views to illustrate the path of the front top flap tucker showing the flaps tucking method which unfolds the said flap as the case moves downwardly through the machine, and more particularly between the inclined side chain conveyors illustrated in FIG. 1.

Referring once again to FIG. 1, inclined chain conveyors 80 and 82 are provided alongside the path of travel for the case downstream of the guide plates and tab slitting knives such that flap folders or tuckers, 84 and 86, associated with these conveyors, 80 and 82 respectively, are adapted to move upwardly between the top and rear closure flaps, and to cam these flaps upwardly, folding them as suggested schematically in FIGS. 8 and 9 respectively. Each of the flaps folders or tuckers 84 and 86 is provided on its associated chain conveyor and a number of these devices may be provided on each of the chain conveyors 80 and 82. Further, each such flap tucker is pivotally mounted so that the orientation of the device with respect to the line of action of the conveyor can be varied pursuant to a contoured cam 88, which cam causes a cam follower roller 90 on a crank arm associated with the device 86 to pivot this particular flap tucker in a counterclockwise direction relative to the line of action 82 of the left-hand conveyor (FIG. 9) thereby raising the flap as suggested in FIG. 9.

FIGS. 12 and 12*b* illustrate the rear and the front flap tuckers, 86 and 84 respectively, and two successive positions for these flap tuckers (in solid and broken lines in each view, associated with movement of the case E in the direction indicated by arrow 120). Each of these flap tuckers 84 and 86 comprise a case, or case flap, engageable part 122, which is preferably made of nylon or a similar plastic material, and this nylon part is pivotally mounted on a stub axle 124 (best shown in FIG. 13). This axle 124 may have a bushing shown, and a base 126 adapted to the inclined conveyor 80 or 82. The nylon part 122 is spring biased clockwise (in both FIG. 12 and FIG. 12*b*) by the spring 129, toward the broken line positions indicated (or to a slightly more inclined position depending upon the resistance to such pivotal motion afforded by the pressure of the case E). A crank arm or lever 130 is attached to nylon part 122 by fasteners 132, 132 so that cam followes 134 will be engaged by a stationary cam (such as shown at 136 or 138 in FIGS. 12 and 12B) in order to pivot nylon part 122 to the substantially vertical orientation shown in solid lines in these views.

FIGS. 12 and 12B show that the above described flap tuckers 86 and 84 not only serve to lift the rear and the front top flaps as suggested in FIGS. 9 and 8 repectively, but that these devices 86 and 84 are also cammed to their vertical positions just as they move up through the horizontal plane defined by the path of the bottom of the case (see line 140 in FIGS. 12 and 12B). Thus, cam 136 in FIG. 4B for example, will have pivoted rear flap tucker 86 back away from the case E when the latter has moved to the left hand position shown in FIG. 12. As the front case E reaches the position shown at the right hand side of FIG. 12B a cam 138, associated with the front flap tucker conveyor 82, will have pivoted the front flap tucker 84 to a similar position (that is, to move it away from the case E as the front flap tucker moves up through the horizontal lane 140 defined by the bottom of the case path.

A second set of cams (one shown at 88 in FIG. 4B) will cause these front and rear top flap tuckers to follow the movements indicated schematically at the right hand side of FIGS. 8 and 9. The left hand sides of FIG. 8 and 9 also show that the case is effectively held between these front and rear devices, and that these cam operated devices are so cammed as to assure that they move up along the end panels of the case to get between the down folded top flaps and the case, to engage the top flaps away from the top flap hinge by pivoting as shown in FIGS. 8 and 9, and to move through the plane 140 in pivoted positions in FIGS. 12 and 12E.

As shown in FIG. 4B the front flap 24 of case F has been raised for enough by the device 84 of FIG. 8 to be plowed down by the periphery of a flap tucking wheel 92. The wheel 92 has a notched portion 94, and this wheel is driven at a peripheral speed much greater than S2 so that the rear flap 26 is engaged by the higher speed notched wheel to be moved forwardly relative to the case in order to assure that this rear top flap 26 is also folded prior to it reaching the position shown for it at the right-hand end of FIG. 4B. Both top flaps 24 and 26 are held in this position by the fixed guide rail 98 provided for this purpose. The guide rail 98 and notched wheel 92 are each mounted on a beam 96, which beam is cantilever supported from a frame 100, and more particularly on a cross shaft 150 in the frame as best shown in FIG. 10, such that the notched wheel and rail 98 can move upwardly about the axis of shaft 150, and against the force of spring 152 in order to avoid damage to the contents of a case in the event that the contents had not been properly loaded in the case prior to being fed into the apparatus of the present invention. Such a condition could cause the top flaps 24 and 26 to be unable to reach the horizontal position shown for them at the right-hand side of FIG. 4B. In FIG. 10 the wheel 92 is shown driven by a chain 152 from a sprocket on shaft 150, which shaft has a second sprocket driven by chain 154 entrained on sprockets mounted in fixed frame 100. As so constructed, the cantilevered beam 96 and notched wheel 92 can be adjusted vertically to accommodate cases of different heights. Guide rail 98 has its leading end mounted in this beam 96, and its trailing end adjustably mounted in depending bracket 156 so that this rail 98 is also adjustable vertically.

The drive mechanism for the various conveyors described above has not been shown, because in this disclosure it is only the relative speeds of the infeed conveyor 38 and the pocket chain conveyor 50 together with the speed of the side chain or side belt conveyors 42 and 44 which is relevant to the invention. The inclined flap tucking conveyors 80 and 82 are driven at a speed such that the horizontal components of motion for the flap folding tuckers 84 and 86 will match the speed of the pocket chain conveyor 50. As mentioned previously, the rotating speed of the notched wheel 92 is preferably faster than that of the pocket chain conveyor in order to provide for folding of the trailing top flap 26 as described above.

A fixed guide 160 may be provided above the path of the cases being handled, as shown in FIG. 4A to assure that the case lowering at the front tab slitting station is positively achieved. The down folded side flaps are also held alongside the case following this tab slitting, and fixed guide rails (not shown) are preferably utilized for this purpose. Where the flap raising or folding chains 80 and 82 do not permit this fixed guide rail the chains themselves are preferably provided with buttons to assure that these side closure flaps remain folded against the case side walls.

DETAILED DESCRIPTION OF FIGS. 14–16B INCLUSIVELY

Turning next to the drawings which show an alternative embodiment for the infeed station of FIGS. 5–6A, and with particular reference to FIG. 14, the speed S2 of pocket chain conveyor 50 is shown by way of reference as a constant value, just as was true of this conveyor 50 in the previously described embodiment of FIGS. 1–4B and FIGS. 7–13 inclusively. So too, cases are provided to this infeed station (from left to right) by line pressure from means (not shown) as described previously.

As in the previously described infeed station infeed conveyor means is provided for separating the cases by slowing their progress as a result of a case A engaging one of the flight bars 36' of an infeed conveyor 38' and being held back thereby due to the relatively slow speed of conveyor 38' at the point of initial contact between said case A and said flight bar 36'. FIG. 16A illustrates this point in time and can be considered analagous to the position of case A in FIG. 6A of the previous embodiment. However, in the original version, the speed S1 of infeed conveyor 38 was constant for a given machine setup whereas the speed S10 of infeed conveyor 38' varies between limits in a manner to be described.

In the preferred version of infeed conveyor 38', depicted in FIGS. 14–16B inclusively, the speed S10 increases from that at initial contact (FIG. 16A) to a maximum at the slightly later instant of time shown in FIG. 16B. The speed S10 of conveyor 38' actually varies sinusoidally as suggested in FIG. 14 so that the maximum speed matches that of the pocket chain conveyor as suggested in FIG. 14 by the reference level S2. This speed S2 also represents the speed of the side belt conveyors 42' and 44', which side belts are functionally equivalent to those described above with reference to FIG. 5 (see side belts 42 and 44).

The cycle of speed change for conveyor 38' (FIG. 14) shows still another position for the case A as it is slowed from a maximum speed (16B) toward the low speed limit described above with reference to FIG. 16A. More particularly in FIG. 16 case A is shown moving onto the infeed conveyor 38' at an intermediate speed. As the case A moves further on conveyor 38 the speed change cycle has completed a period, and by reference to case B in FIG. 16A, which is moving at the low limit speed, and is held back by flight bar 36'c, it will be apparent that the case B will be again accelerated before leaving the conveyor 38'.

Continuing on through a second speed cycle for the infeed conveyor 38', as suggested in FIG. 14, we see that case B will also accelerate from the FIG. 16A low speed condition to the FIG. 16B high speed condition. As the flight bar 36'c moves downwardly out of the path of movement for case B (compare FIGS. 16B and 16) the side belts 42' and 44' (like those described above with reference to FIG. 5 at 42 and 44) positively advance the case B forwardly against the leading flight bar 52 of pocket chain conveyor 50 as shown by the position for case B in FIG. 16.

The two relatively short case engaging portions of these side belts 42' and 44' are such that they engage the case B at this particular time to effect this positive advancing motion, and as in the previously described embodiment these side belts 42' and 44' move at substantially the same speed S2 as that of the pocket chain conveyor itself. The presence of leading flight bar 52 at the position for receiving case B is assured by the fact that these side belts are directly driven from the same motor (not shown).

By reference to FIG. 16, it will be apparent that the driven pocket chain conveyor 50 rotates shaft 202 through the pocket chain conveyor sprocket shown. A chain 200 is for driving a right angle gear unit M. Two verical drive shaft assemblies 204 are driven by unit M to operate the side belt conveyors 42' and 44' by direct drive through each downstream end roller 206 and 208 associated with these side belts 42' and 44' respectively.

Turning next to the variable speed drive for infeed conveyor 38' means is provided for driving this conveyor at a speed which varies cyclically as described above and as shown in FIG. 14, and for synchronizing this conveyor 38' with movement of the pocket chain conveyor 50 and of the side belt conveyors 42' and 44'. The shaft 202 associated with pocket chain 50 also has a sprocket 210 at its opposite end and chain 217 (best shown in FIG. 16) is driven thereby.

This chain 217 drives a sprocket 214 on the same side of the infeed conveyor as sprocket 210 (see FIG. 15) and the shaft 216 comprises an input shaft for a variable speed drive unit of the type having a drive pin roller 218 mounted for rotation about the input shaft 216 (see FIGS. 16, 16A and 16B) and meshing with a slotted crank 220 which rotates on output or driven shaft 222. These shafts 216 and 222 are offet from one another (as shown in FIG. 15) and the variable speed output shaft 222 has a sprocket 215 which imparts this variable speed motion to the driven end 230 of infeed conveyor 38' through chain 228.

As so constructed and arranged the end-to-end cases approaching the infeed station of the FIG. 1 apparatus, for tab slitting and flap folding etc., are each held back by the flight bars 36', 36'a, 36'b and 36'c and allowed to accelerate up to the desired speed of pocket chain conveyor 50. The infeed conveyor has its active run (along the path of case movement) of sufficient length to provide for each of these flight bars 36', 36'a, 36'b and 36'c to go through $1\frac{1}{2}$ cycles while each bar is in contact with an associated case. For example, flight bar 36' in FIG. 16A shows the start of such a $1\frac{1}{2}$ cycle speed change and flight bar 36'c shows the end of such a $1\frac{1}{2}$ cycle speed change. Initially the speed is at the low limit in FIG. 14 and at the end the speed has been matched to that of the pocket chain conveyor (S2 in FIG. 14).

I claim:

1. In apparatus for moving the front and rear top flaps of an upwardly open packing case away from their folded positions alongside the front and rear end panels of a packing case while the case is moving, said apparatus including conveyor means for moving the case in a horizontal path, the improvement comprising transversely opposed flap folding chains, said chains provided on either side of said case path, and having active runs moving downstream at the same horizontal speed as that of the cases, at least one flap engageable tucker provided pivotally on each chain and cam track means for engaging portions of said flap tuckers, portions of said tuckers moving upwardly into the path of said cases as the tucker moves in the downstream direction to selectively contact the case front and rear end walls for locating the case therebetween and for folding the front and rear top flaps of the case.

2. The apparatus of claim 1 wherein said cam track means associated with both chains for engaging portions of said flap tuckers serves to pivot them away from the front and rear end panels of the case as said tuckers are moved by said chains, and spring biasing means to urge said flap tuckers toward the case end panels.

3. In an apparatus for handling packing cases so as to provide a separation between adjacent packing cases in a line of end-to-end cases, and for folding at least the front and rear top flaps thereof after the case has been loaded, the improvement comprising an infeed flight bar conveyor having transverse flight bars defining a case path in which the flight bars move at a speed S which varies cyclically between an upper limit determined by the speed of movement of the cases through the machine S2 and a lower limit speed S1, said infeed flight bars spaced apart by a distance D1 on said infeed conveyor and driven at said variable speed S in synchronized relationship with the speed S2, which limit speeds are related to one another in accordance with the relationship S1 over S2 is less than or equal to D1 over D2 where D2 equal the spacing between the cases moving through the apparatus, said improvement further including means for moving the front and rear top flaps of the packing case away from their folded positions alongside the front and rear end panels thereof, said improvement including transversely opposed flap folding chains, said chains provided on either side of said case path, and having active runs moving downstream at the same horizontal speed as that of the case (S) at least one flap engageable tucker provided pivotally on each chain, and cam track means for engaging portions of said flap tuckers, portions of said tuckers moving upwardly into the path of said cases as the tucker moves in a downstream direction to selectively contact the case front and rear endwalls for locating the case therebetween and for folding the front and rear top flaps of the case.

4. The apparatus of claim 3 wherein said infeed conveyor has an upper run of sufficient length to provide for approximately one and on-half ($1\frac{1}{2}$) cycles of speed change for each said flight bar during its contact with a particular case being fed into a particular pocket of said pocket conveyor.

5. The apparatus of claim 4 wherein said speed S of each infeed flight bar moving through said upper run varies from said low limit speed S1 upon initial contact with a case entering said infeed conveyor through said maximum speed S2 and decreases to said low limit speed S1 to again return to said maximum speed at the downstream end of said upper run of said infeed conveyor.

6. The apparatus of claim 5 wherein said flight bar spacing D1 is less than the longitudinal in-line dimension of the packing cases to be separated so that the forward end of each case moving into the infeed station, engages.the rear of one flight bar lifts that case slightly whereby the line of cases is held back until the said one flight bar moves downwardly out of said upper run which defines the path of the cases on said infeed flight bar conveyor.

7. The apparatus of claim 6 further characterized by auxiliary means at said infeed station between the downstream end of said infeed flight bar conveyor means and the upstream end of said pocket chain conveyor, said auxiliary means controlling each case as it is moved off said infeed flight bar coveyor and into a pocket on said pocket conveyor.

8. The apparatus of claim 7 wherein said auxiliary means at said infeed station comprises side belts which are driven at a lineal speed at least approximately equal to the speed S2 of said pocket conveyor, said belts including active portions which move into contact with each case moving off said infeed flight bar conveyor and which portions move at substantially the same speed as the maxinum speed of said flight bars during said case movement into a pocket on said pocket conveyor.

* * * * *